US005762291A

United States Patent [19]

Hollis et al.

[11] Patent Number: 5,762,291

[45] Date of Patent: Jun. 9, 1998

[54] DRAG CONTROL MODULE FOR STABILIZED PROJECTILES

[75] Inventors: Michael S. L. Hollis, Abingdon; Fred J. Brandon, Aberdeen, both of Md.

[73] Assignee: The United States of America as represented by the Secretary of the Army, Washington, D.C.

[21] Appl. No.: 924,515

[22] Filed: Sep. 5, 1997

Related U.S. Application Data

[62] Division of Ser. No. 738,488, Oct. 28, 1996, abandoned.

[51] Int. Cl.[6] ..... F42B 10/00

[52] U.S. Cl. ..... 244/3.24; 244/3.25; 244/3.27; 244/3.21

[58] Field of Search ..... 244/3.24, 3.25, 244/3.26, 3.27, 3.28, 3.29, 3.21, 3.1, 49; 102/529

[56] References Cited

U.S. PATENT DOCUMENTS

| | | | |
|---|---|---|---|
| 1,096,907 | 5/1914 | Gulick | 102/398 |
| 1,152,668 | 9/1915 | Sullivan | 102/400 |
| 1,166,879 | 1/1916 | Alard | 102/400 |
| 1,243,542 | 10/1917 | Moore | 244/3.27 |
| 1,300,708 | 4/1919 | Edison | 102/400 |
| 2,981,183 | 4/1961 | Godfrey | 102/386 |
| 3,457,862 | 7/1969 | Mardarello et al. | 102/400 |
| 3,588,004 | 6/1971 | Suter | 244/3.27 |
| 4,332,360 | 6/1982 | Topliffe | 244/3.27 |
| 4,384,691 | 5/1983 | Madderra | 244/3.27 |
| 4,533,094 | 8/1985 | Geis et al. | 244/3.24 |
| 4,565,340 | 1/1986 | Bains | 244/3.28 |
| 4,600,167 | 7/1986 | Kastenhuber et al. | 244/3.28 |
| 4,635,881 | 1/1987 | Brieseck et al. | 244/3.24 |
| 4,655,420 | 4/1987 | Spiroff | 244/3.24 |
| 4,667,899 | 5/1987 | Wedertz | 244/3.24 |
| 4,709,877 | 12/1987 | Goulding | 244/3.28 |
| 4,944,226 | 7/1990 | Wedertz et al. | 244/3.27 |
| 5,031,856 | 7/1991 | Steuer et al. | 244/3.27 |
| 5,048,773 | 9/1991 | Washington et al. | 102/386 |
| 5,131,602 | 7/1992 | Linick | 244/3.14 |
| 5,221,358 | 6/1993 | Bagley | 244/3.27 |
| 5,642,867 | 7/1997 | Klestadt | 244/3.27 |

*Primary Examiner*—Charles T. Jordan
*Assistant Examiner*—Theresa M. Wesson
*Attorney, Agent, or Firm*—Paul S. Clohan

[57] ABSTRACT

A trajectory (range) control device which is designed to fit behind the fuze of a fin stabilized ballistic projectile for correcting range error. The trajectory (range) control device is a self-contained, add-on module, which will screw into the forward portion of the projectile. The fuze will then screw into the trajectory (range) control module, which has a small through hole that will coincide with the center of the fuze and the center of the projectile. This through hole is intended to provide a channel in which the fuze can detonate the intended booster charge which will in turn ignite the high explosive payload or function the payload of the fin stabilized ballistic projectile. The trajectory control device will not make changes to the existing projectile or fuze. During the course correction phase, eight spring loaded flare tabs will deploy from the device. The flare tabs create a blunt cross-sectional area in front of the projectile, thus creating more drag and effectively slowing the projectile.

4 Claims, 4 Drawing Sheets

DRAG CONTROL MODULE FOR STABILIZED PROJECTILES

This application is a divisional of application Ser. No. 08/738,488, filed Oct. 12, 1996 now abandoned.

GOVERNMENTAL INTEREST

The invention described herein may be manufactured used and licensed by or for the United States Government without payment to me of any royalty thereon.

TECHNICAL FIELD

The present invention relates to tube launched projectiles in general, and specifically to a device for one-dimensional trajectory (range) control of fin stabilized ballistic projectiles.

BACKGROUND ART

It was well recognized in the prior art that a tube launched projectile followed a ballistic trajectory which could be fairly well calculated. This knowledge enabled a gunner to fire a projectile to impact a preselected target area with reasonable accuracy and consistency. However, a major disadvantage of a ballistic projectile was the inability to control its trajectory after launch. Course correction is difficult with these types of projectiles. It is well known that the major source of trajectory error is in range, not deflection, for a ballistic projectile. As shown in FIG. 1, projectile 20 is fired from gun tube 24 at intended target B, but due to wind and other meteorological conditions, muzzle velocity error, aiming error, etc., projectile 20 actually impacts at point A. With current technology, at some point along the trajectory of projectile 20, the impact point error can be determined, but a course correction was not possible once projectile 20 leaves gun tube 24.

If course correction was available, the gunner could deliberately aim past the target. Then, during the flight of the projectile, a combination of on-board electronics such as a Global Positioning Sensor (GPS), and/or an Inertial measurement Unit (IMU), and a Central Processing Unit (CPU) would determine the actual ballistic path and predicted point of impact with respect to the intended trajectory and target location. A trajectory (range) control device could be preprogrammed with the intended trajectory before the projectile is fired. At a certain point in the flight, the CPU would determine when to initiate the trajectory (range) control device. Once initiated, the projectile will slow down, ultimately bringing it closer to the intended target.

STATEMENT OF THE INVENTION

It is therefore an object of the present invention to provide a simple trajectory (range) control device for a fin stabilized ballistic projectile that will enhance range accuracy.

A further object of the present invention is to provide a trajectory (range) control device that will provide a cost effective solution to correcting range error in fin stabilized ballistic projectiles.

A still further object is to provide a trajectory control device that is a self-contained, add-on module for fin stabilized ballistic projectiles, that requires no modification to the existing item, or its existing fire control system.

Still other objects and advantages of the present invention will become readily apparent to those skilled in this art from the detailed description, wherein only the preferred embodiment of the present invention is shown and described, simply by way of illustration of the best mode contemplated of carrying out the present invention. As will be realized, the present invention is capable of other and different embodiments, and its several details are capable of modifications in various obvious respects, all without departing from the present invention. Accordingly, the drawings and descriptions are to be regarded as illustrative in nature, and not as restrictive.

These and other objects are achieved by a trajectory control device designed to fit behind the fuze of a fin stabilized ballistic projectile. To minimize the impact on the projectiles overall aerodynamic profile, and physical characteristics, the device is very compact. Our trajectory control device is also a very cost effective solution to correcting range error. Our trajectory control device is a self-contained, add-on module, which will screw into the forward portion of the projectile. The fuze will then screw into the trajectory control module, which has a small through hole that will coincide with the center of the fuze and the center of the projectile. This through hole is intended to provide a channel in which the fuze can detonate the intended booster charge which will in turn ignite the high explosive payload or function other payloads (i.e., flare, smoke, etc.) of the fin stabilized ballistic projectile. Thus, our trajectory control device will not make changes to the existing projectile or fuze. During the course correction phase, eight spring loaded flare tabs will deploy from the device. The flare tabs create a blunt cross-sectional area in front of the projectile, thus creating more drag and effectively slowing the projectile.

DETAILED DESCRIPTION OF THE PREFERRED EMBODIMENT

Figure 1:
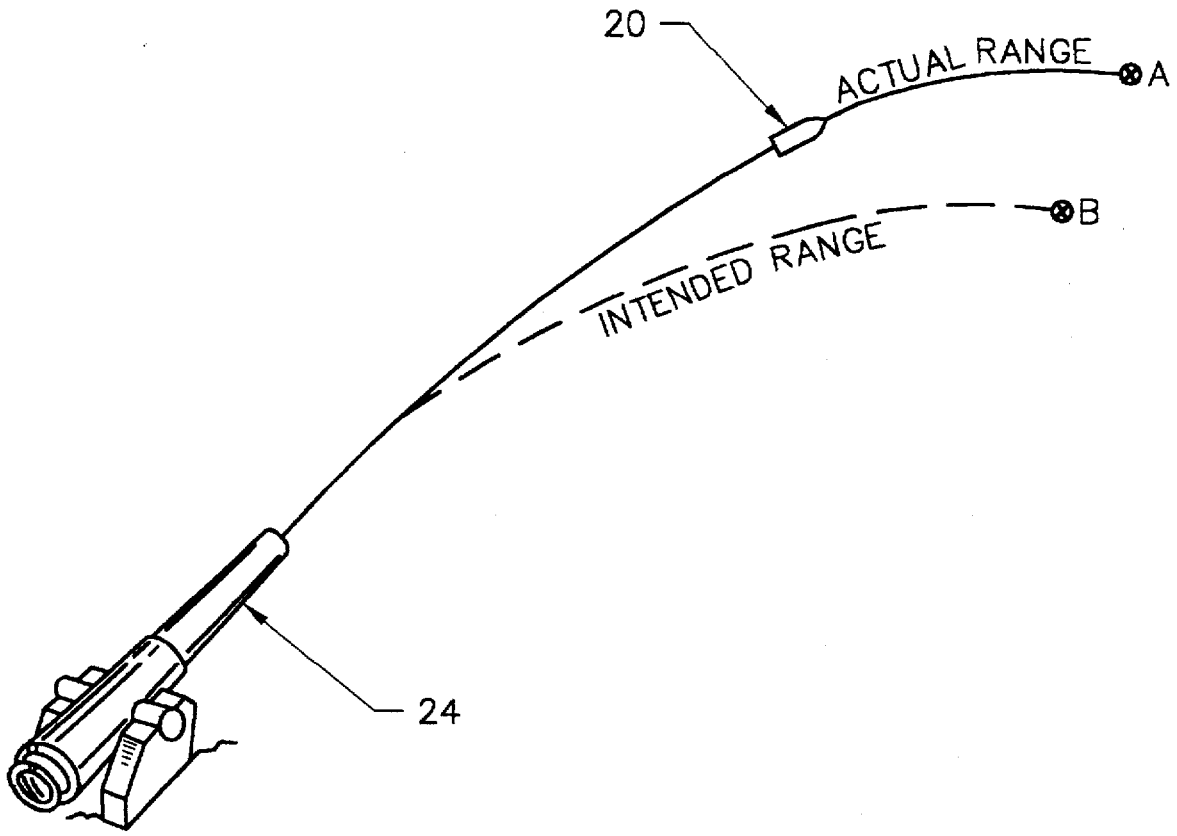
FIG. 1 depicts the intended path and the actual path of a projectile fired from a gun tube.
Figure 2:
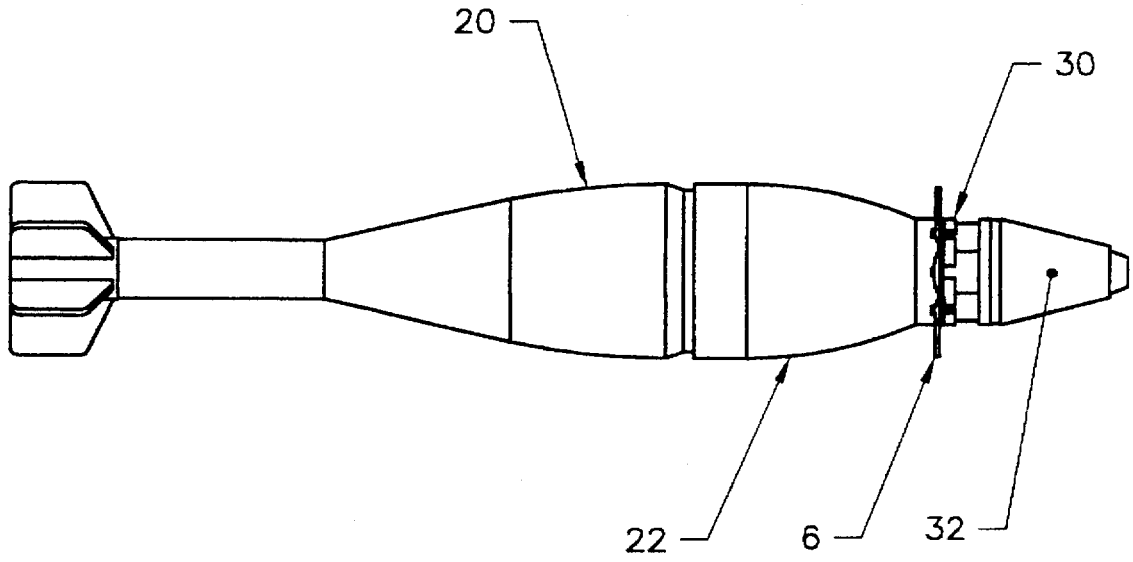
FIG. 2 depicts a fin stabilized ballistic projectile with our trajectory control device attached.

Referring now in detail to the drawings wherein like parts are designated by like reference numerals throughout, there is illustrated in FIG. 2 a fin stabilized ballistic projectile 20 with our trajectory control device 30 attached, which is a self-contained, add-on module, that will screw into fin stabilized ballistic projectile 20 between projectile body 22 and fuze 32. Trajectory control device 30 has a small through hole that will coincide with the center of fuze 32 and the center of projectile body 22. This-through hole is intended to provide a channel through which fuze 32 can detonate the intended booster charge which will in turn ignite the high explosive payload of fin stabilized ballistic projectile 20. The intent of trajectory control device 30 is to provide a device that will not require modification to existing projectiles or fuzes.

Figure 3A:
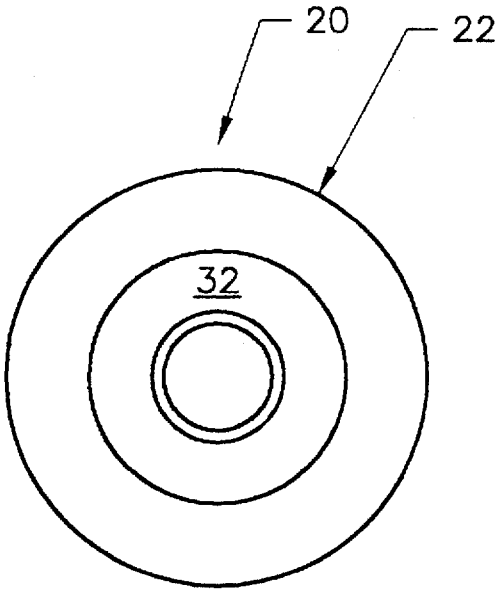
FIG. 3A is a front view of a fin stabilized projectile before deployment of our trajectory control device.
Figure 3B:
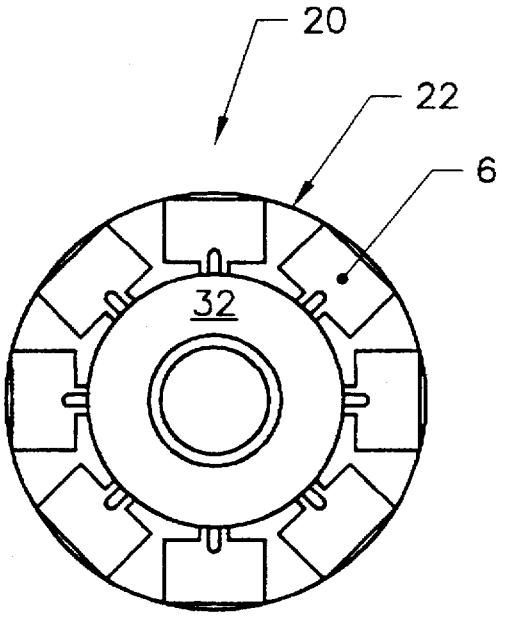
FIG. 3B is is a front view of a fin stabilized projectile after deployment of our trajectory control device.

A view of the front of fin stabilized projectile 20 before deployment can be seen in FIG. 3A. During the course correction phase, eight spring loaded flare tabs 6 will deploy from trajectory control device 30. A view of the front of fin stabilized projectile 20 after the flare tabs have been deployed can be seen in FIG. 3B. The flare tabs create a blunt cross sectional area in front of projectile 20, thus creating more drag and effectively slowing projectile 20.

Figure 4:
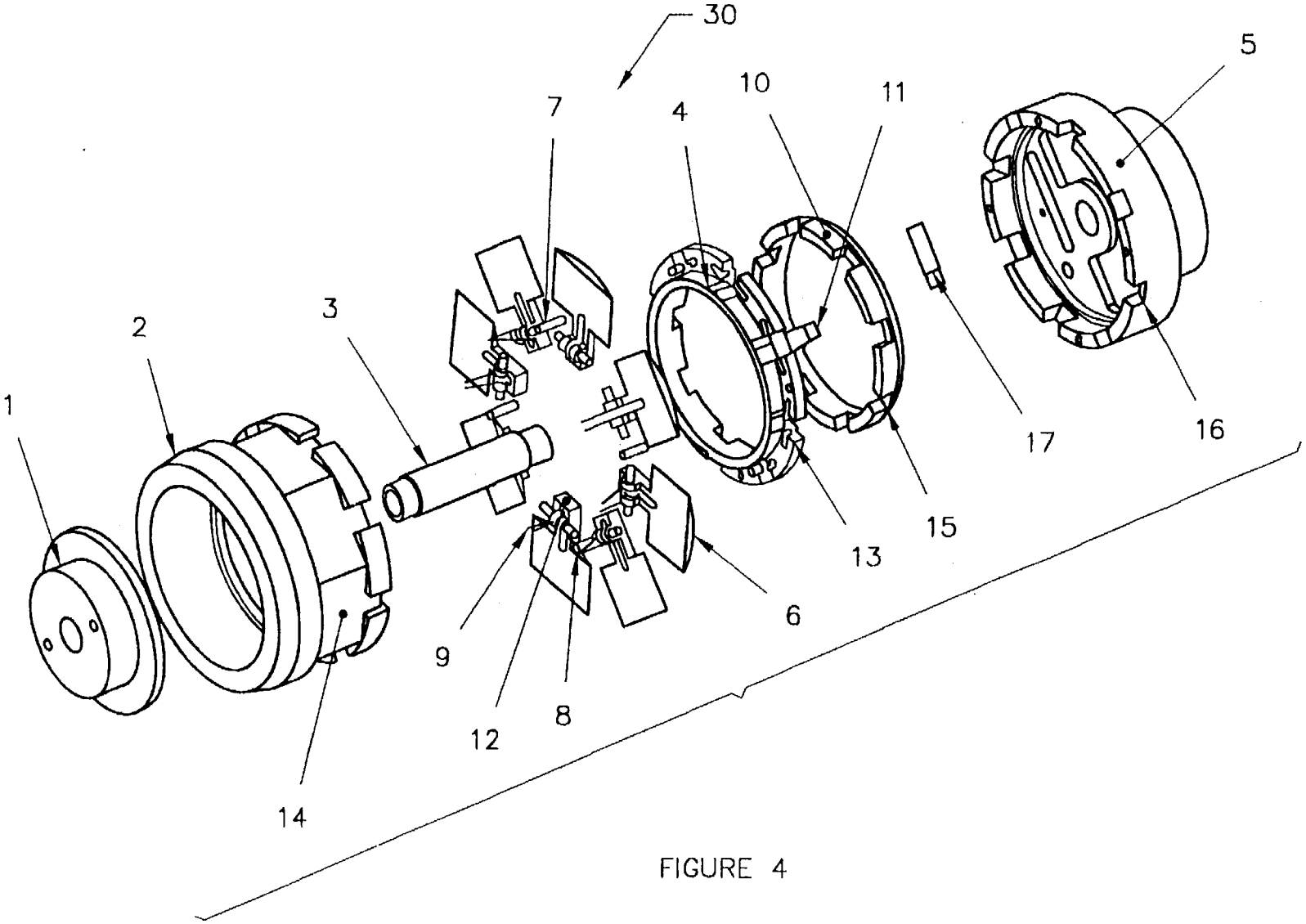
FIG. 4 is an exploded view of our trajectory control device.

An exploded view of trajectory control device 30 is shown in FIG. 4. Trajectory control device 30 consists of a Micro-Miniature Piston Actuator (MMPA) 17, locking ring 10, eight sets of axles 8, torsion springs 9, and flare tabs 6. During deployment, MMPA 17, will push the locking ring arm 11 such that locking ring 10 will rotate inside of aft module 5. Up to this point, locking ring grooves 15 do not line up with aft module grooves 16. Locking ring 10 is restraining the tails of eight tabs 12, keeping flare tabs 6 from deploying. The deploying force on flare tabs 6 comes from torsion springs 9 which allow flare tabs 6 to rotate about their respective axles 8. When the grooves from both aft module 5 and locking ring 10 line up, flare tabs 6 will be free to deploy.

Axles 8 are nested in hinge grooves 13 which are contained in the middle module 4. Also, forward module 2 sits on top of middle module 4, closing hinge grooves 13. Forward module 2 also provides slots 14 into which flare tabs 6 sit before deployment. Spring pins 7 provide circumferential alignment of the forward, middle, and aft modules.

The entire trajectory control device 30 is held together via flame tube 3. Flame tube 3 is first screwed into aft module 5. All of the components are then stacked onto aft module 5. End cap 1 is then screwed onto flame tube 3, effectively clamping the entire assembled device. The second purpose of flame tube 3 is to provide a channel in which fuze 32 will send a flame through in order to detonate a booster charge which will in turn ignite the high explosive or function the payload within fin stabilized ballistic projectile 20.

An example of the deployment of flare tabs 6 would be in a scenario where device 30 is used with a mortar. Regardless of the slight centripetal forces that may build up on projectile 20, flare tabs 6 are spring loaded and will deploy due to the spring force of torsion springs 9 and the aerodynamic loads. Locking ring 10 releases the eight flare tabs 6 for deployment.

It will be readily seen by one of ordinary skill in the art that the present invention fulfills all of the objects set forth above. After reading the foregoing specification, one of ordinary skill will be able to effect various changes, substitutions of equivalents and various other aspects of the present invention as broadly disclosed herein. It is therefore intended that the protection granted hereon be limited only by the definition contained in the appended claims and equivalents thereof.

Having thus shown and described what is at present considered to be the preferred embodiment of the present invention, it should be noted that the same has been made by way of illustration and not limitation. Accordingly, all modifications, alterations and changes coming within the spirit and scope of the present invention are herein meant to be included.

What is claimed is:

1. A device to control the range of trajectory of a fin stabilized projectile having a fuze located in the nose of the projectile comprising:

an add-on drag producing module removably located in the forward portion of said projectile between the body of said projectile and the fuze of said projectile; said module having attachment means on either end designed to mate with said fuze and said projectile such that said module can be attached to said projectile at a time Prior to launch of said projectile by removing the fuze from said projectile, attaching one end of said module to said projectile body and then re-attaching said fuze to the other end of said module;

said module also comprising means for extending into the airstream a plurality of flat planar tab-like projections such that said flat planar tab-like projections are extended into the airstream such that the surface having a greater cross-sectional area of each tab-like projection is perpendicular to said airstream thereby creating an overall blunt cross sectional area in the forward portion of said projectile immediately behind said fuze so as to create drag on said projectile and to slow said projectile during flight and thereby alter the trajectory of said projectile.

2. The device of claim 1 wherein said means for extending into the airstream a plurality of flat planar tab-like projections comprises a plurality of flare tabs each having a flat planar tab-like projection deployed by an actuator.

3. The device of claim 2 wherein said actuator rotates a rotating locking ring to control the deployment of said flare tabs.

4. The device of claim 3 wherein said flare tabs are extended into the airstream by a plurality of torsion springs.

* * * * *